US007540225B2

(12) United States Patent
Lee

(10) Patent No.: US 7,540,225 B2
(45) Date of Patent: Jun. 2, 2009

(54) DOUBLE-FACED ADHESIVE TAPE DISPENSER

(76) Inventor: Sang Chul Lee, 701-1403 Jugong Apt., 295 Haan-dong, Gwangmyeong-si, Gyeonggi-do (KR) 423-060

( * ) Notice: Subject to any disclaimer, the term of this patent is extended or adjusted under 35 U.S.C. 154(b) by 331 days.

(21) Appl. No.: 10/599,013

(22) PCT Filed: Apr. 21, 2005

(86) PCT No.: PCT/KR2005/001153

§ 371 (c)(1),
(2), (4) Date: Sep. 18, 2006

(87) PCT Pub. No.: WO2005/113397

PCT Pub. Date: Dec. 1, 2005

(65) Prior Publication Data

US 2007/0194165 A1 Aug. 23, 2007

(30) Foreign Application Priority Data

Apr. 21, 2004 (KR) ..... 10-2004-0027503
Nov. 5, 2004 (KR) ..... 10-2004-0090002

(51) Int. Cl.

| | |
|---|---|
| ***B26D 7/00*** | (2006.01) |
| ***B26F 3/02*** | (2006.01) |
| ***B65H 35/10*** | (2006.01) |
| ***B29C 65/00*** | (2006.01) |
| ***B32B 37/00*** | (2006.01) |
| ***B65C 9/25*** | (2006.01) |
| ***B65C 11/02*** | (2006.01) |

(52) U.S. Cl. ..... 83/649; 225/46; 225/42; 225/11; 225/14; 225/16; 156/579; 156/323; 156/384

(58) Field of Classification Search ..... 83/649; 225/10, 11, 14, 46, 42; 156/579, 323, 384
See application file for complete search history.

(56) References Cited

U.S. PATENT DOCUMENTS 5,073,228 A * 12/1991 Lin ..... 156/523
5,454,500 A * 10/1995 Chen ..... 225/46

(Continued)

FOREIGN PATENT DOCUMENTS

JP 02-055669 U 4/1990

(Continued)

*Primary Examiner*—Ghassem Alie
*Assistant Examiner*—Bharat C Patel
(74) *Attorney, Agent, or Firm*—Kirton & McConkie; Evan R. Witt

(57) ABSTRACT

The present invention relates to a double-faced adhesive tape dispenser which does not only include automatic drawing means and cutting means to enhance the convenience of users but also includes guide means to increase the efficiency in using a double-faced adhesive tape. The tape dispenser of the present invention includes a case body having a receptor to receive an adhesive tape therein; a cover; a connecting means; a locking means; a drawing means including a trigger protruded through an opening of the case body, and a pair of drums in contact with a bottom surface of the adhesive tape to draw out the adhesive tape; a cutting means including an operating button, a lever and a cutter to cut the adhesive tape; and a guide means to guide withdrawal of the adhesive tape in the case body.

5 Claims, 3 Drawing Sheets

U.S. PATENT DOCUMENTS

| | | | | | |
|---|---|---|---|---|---|
| 5,472,560 | A * | 12/1995 | Horng | 156/577 |
| 5,910,227 | A * | 6/1999 | Mistyurik et al. | 156/384 |
| 6,065,519 | A * | 5/2000 | Lee | 156/523 |
| 6,176,409 | B1 * | 1/2001 | Lee | 225/16 |
| 6,651,857 | B1 * | 11/2003 | Tsai | 225/42 |

FOREIGN PATENT DOCUMENTS

| | | | |
|---|---|---|---|
| JP | 04-096460 | U | 8/1992 |
| JP | 12-143077 | A | 5/2000 |
| JP | 12-143078 | A | 5/2000 |

* cited by examiner

[Fig. 1]
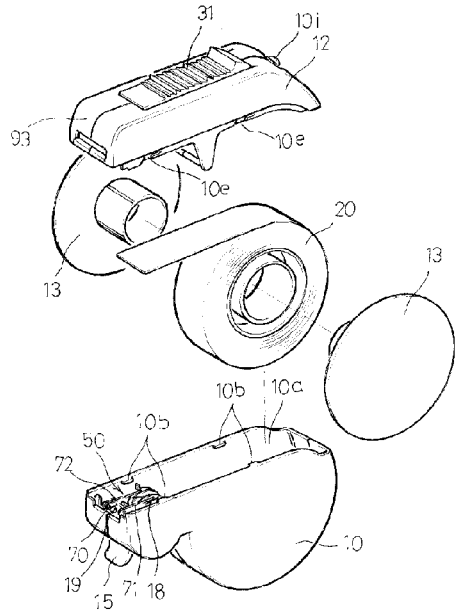
[Fig. 2]
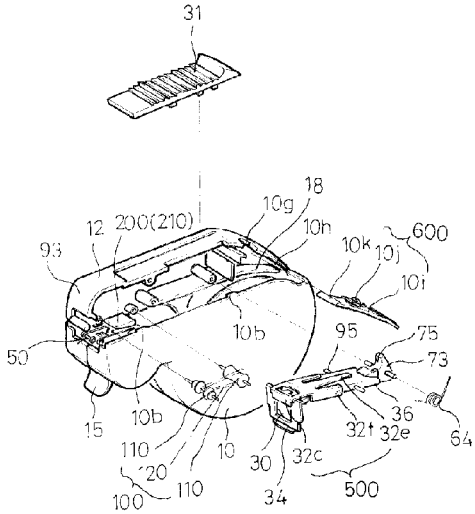
[Fig. 3]
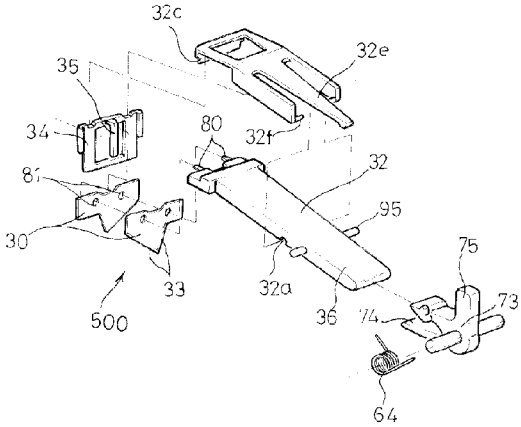

[Fig. 4]
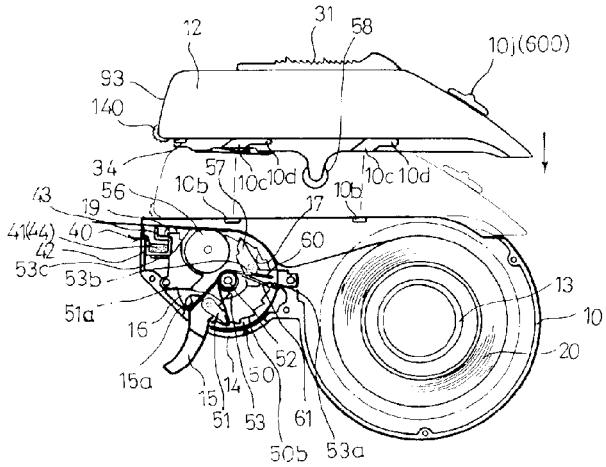
[Fig. 5]
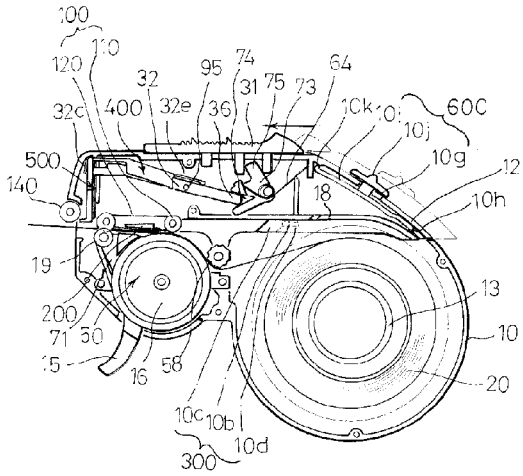
[Fig. 6]
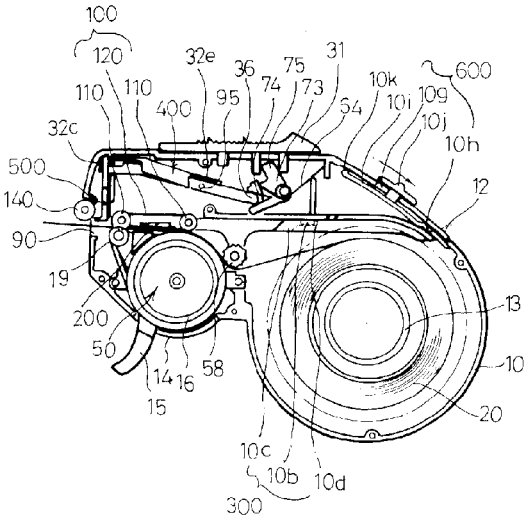

[Fig. 7]
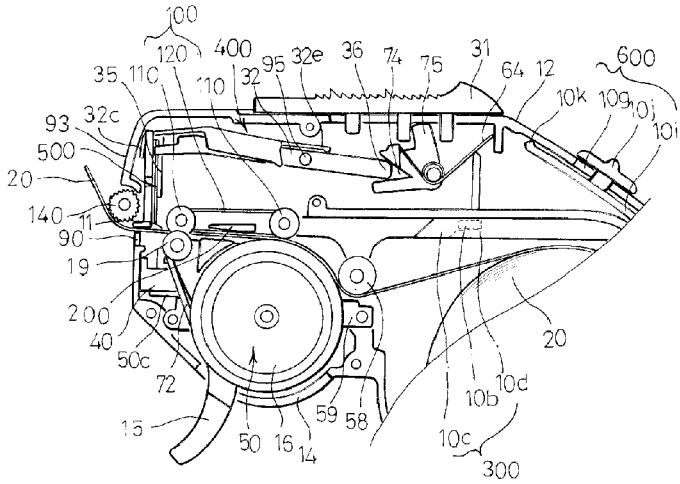
[Fig. 8]
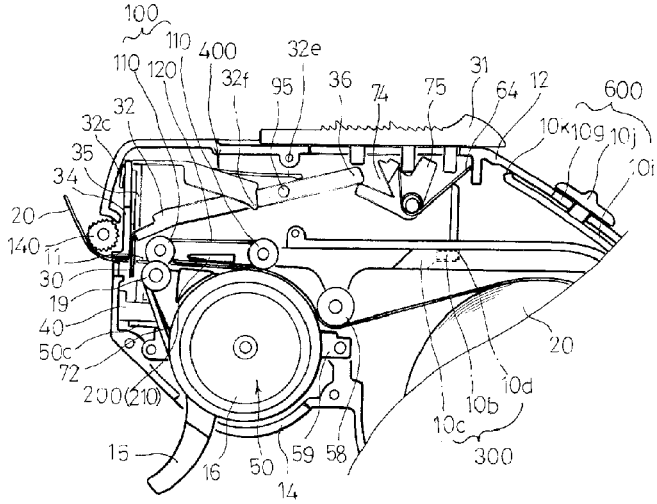
[Fig. 9]
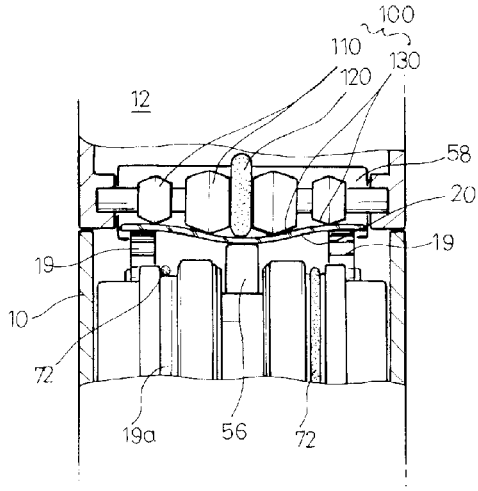

DOUBLE-FACED ADHESIVE TAPE DISPENSER

TECHNICAL FIELD

The present invention relates to a double-faced adhesive tape dispenser, and more particularly to a double-faced adhesive tape dispenser which does not only include automatic drawing means and cutting means to enhance the convenience of users but also includes guide means to increase the efficiency in using a double-faced adhesive tape.

BACKGROUND ART

Generally, a tape lined with an adhesive on one side or both sides is used to stick papers or other articles together. It is wound on a roll and is received in a case.

The case for the adhesive tape is usually made of transparent synthetic resin material such as acryl, so that a user can see the adhesive tape therein at any time.

A conventional case for the adhesive tape was formed in a rounded barrel type having an opening on one side, and it had a cylindrical axis in the center thereof, so that the adhesive tape wound on the roll could fit onto the cylindrical axis and rotate freely centering around the axis.

The opening of the case was usually covered with a paper cap.

The adhesive tape case had an outlet at one end, through which a front end of the tape could be drawn out. At the outlet, a securing part was provided to have the front end of the tape attached thereto. In front of the securing part, a cutting means having a plurality of sharp teeth was provided in a line.

When the adhesive tape received in such a conventional tape case was to be used, a user first had to grasp the front end of the adhesive tape with one hand. Then, the user had to detach it from the securing part and pull it as long as necessary until a pre-determined length of adhesive tape was withdrawn and cut by the cutting means. All these procedures had to be taken manually and it was not convenient. Also, it was not sanitary to grasp and detach the adhesive tape with fingers of the user.

In order to increase the convenience of users, the inventor of the present invention suggested an adhesive tape dispenser in Korean Patent Application No. 1999-35136 and Patent No. 355548. The adhesive tape dispenser had an automatic drawing means, which could be used like a trigger of a gun without touching one's finger on the adhesive tape. Also, it had a cutting means, which could be used by merely pushing an operating button and could cut the tape clean.

Specifically, the adhesive tape dispenser by the inventor comprised a gun-shaped case body; a detachable cover; a drawing means having a trigger protruded from a part of the case body and a pair of drums rotating in line with the trigger; and a cutting means including an operating button mounted on a surface of the case body, a lever working in association with the operating button, and a cutter provided at a front end of the lever.

With the above adhesive tape dispenser, by putting one's finger on the trigger and pulling the trigger once or several times, the adhesive tape could be drawn from the case body as long as necessary without touching and pulling the adhesive tape with one's hand. Further, by pulling the operating button on the surface of the case body, the adhesive tape with a desired length could be cut clean.

DISCLOSURE OF INVENTION

Technical Problem

When the adhesive tape had been used up and it needed to be replaced with a new adhesive tape, the cover should be detached from the case body and the new tape should be installed in the body in place of the consumed one. However, as the cutting means and the drawing means were provided together in one case body, the mechanism of changing the tapes in the case body was relatively complicated and it was not easy for a user to position the new tape in the case body.

That is, in order for the new adhesive tape to be drawn out and used after being positioned in the case body, the tape should fit between the cutting means and the drawing means. However, as there was little space between the cutting means and the drawing means, it was not easy to fit the tape therebetween.

Further, as the mechanism of using the cutting means to cut the adhesive tape which has been drawn out by the drawing means was complicated, it was not effective in terms of manufacturing cost and efficiency. Further, when a double-faced adhesive tape was to be used in such a tape dispenser, as the tape was lined with an adhesive on both sides, it was much more difficult to fit the tape between the cutting means and the drawing means than the conventional one-faced adhesive tape.

Technical Solution

In order to overcome the above disadvantages of the conventional tape dispenser, the present invention provides an improved adhesive tape dispenser having a cover including a cutting means therein and provided separately from a case body to be connected to the case body by a connecting means, so that users can easily replace a used-up adhesive tape with a new one.

Further, the present invention provides an improved dispenser for double-faced adhesive tape, which comprises a guide means to facilitate the installation and supply of the double-faced tape and enhance the convenience of users.

Furthermore, since the present invention can be applied to both one-faced adhesive tape and double-faced adhesive tape, it is efficient and economical.

Advantageous Effects

According to the present invention, as the case body and the cover of the tape dispenser are separately provided and can be connected by a connecting means, the efficiency of assembly and disassembly of parts of the tape dispenser can considerably be improved.

According to the present invention, as the cutting means is contained in the cover, users can easily replace a used-up adhesive tape with a new one.

Further, according to the present invention, the cutting means includes an elastic member which can be assembled easily and facilitate the operation of the cutting means, and thus the reliability of the products can be improved.

Furthermore, according to the present invention, not only one-faced adhesive tapes but also double-faced tapes can be supplied smoothly through a guide means and can be exchanged easily and conveniently.

Furthermore, since the parts of the tape dispenser of the present invention are separately formed and can be easily assembled, the manufacturing efficiency can be enhanced.

BRIEF DESCRIPTION OF THE DRAWINGS

FIG. 1 is an exploded perspective view of an adhesive tape dispenser according to the present invention, wherein a cover is separated from a case body.

FIG. 2 is a partially exploded perspective view showing a cutting means installed in the adhesive tape dispenser of the present invention.

FIG. 3 is an exploded perspective view of the cutting means of the adhesive tape dispenser according to the present invention.

FIG. 4 is a front sectional view showing steps whereby the cover of the adhesive tape dispenser becomes connected with the case body.

FIG. 5 is a front sectional view showing a state before the cover is locked with the case body of the adhesive tape dispenser.

FIG. 6 is a front sectional view showing a state where the cover is locked with the case body of the adhesive tape dispenser.

FIG. 7 is a partial sectional view of the adhesive tape dispenser before the cutting means is operated.

FIG. 8 is a partial sectional view of the adhesive tape dispenser when the adhesive tape is cut by the cutting means.

FIG. 9 is a partial side sectional view showing a state where the double-faced adhesive tape is drawn out by a drawing means.

BEST MODE FOR CARRYING OUT THE INVENTION

The preferred embodiments of the present invention will be described in detail with reference to the accompanying drawings. According to the present invention, a double-faced adhesive tape dispenser comprises: a case body (10) in the form of a gun having an open top and a receptor (10*a*) to receive an adhesive tape (20) therein;

a cover (12) provided above the case body (10);

a connecting means (300) to connect a lower end of the cover (12) and a upper end of the case body (10);

a locking means (600) to prevent the cover (12) from being released from the case body (10);

a drawing means (50) including a trigger (15) protruded through an opening (14) of the case body (10), and a pair of drums (16) rotated by pulling the trigger (15) with a finger and in contact with a bottom surface of the adhesive tape (20) to draw out the adhesive tape (20);

a cutting means (500) including an operating button (31) mounted on a surface of the cover (12), a lever (32) operated by moving the operating button (31) and connected to an elastic member (400), and a cutter (30) provided at a front end of the lever (32) and having a blade (33) to cut the adhesive tape (20) which has been drawn out by the drawing means (50); and a guide means (100) provided above the drums (16) to be in contact with a top surface of the adhesive tape (20) and to guide withdrawal of the adhesive tape (20) in the case body (10).

According to the present invention, since the case body (10) and the cover (12) can be simply connected and disconnected by the connecting means (300), users can exchange adhesive tapes easily and conveniently.

Further, as the guide means (100) is in contact with the top surface of the adhesive tape (20) and guides the withdrawal of the adhesive tape (20), double-faced adhesive tapes as well as one-faced tapes can be effectively and conveniently withdrawn and cut.

Mode for the Invention

The preferred embodiments of the present invention will be described in detail with reference to the accompanying drawings.

FIG. 1 is an exploded perspective view of the adhesive tape dispenser showing that the cover (12) is separated from the case body (10).

FIG. 2 shows the cutting means (500) provided in the adhesive tape dispenser, and FIG. 3 is an exploded perspective view of the cutting means (500).

FIG. 4 shows steps whereby the cover (12) becomes connected with the case body (10), and FIG. 5 shows a state before the cover (12) is locked with the case body (10).

FIG. 6 shows a state where the cover (12) is locked with the case body (10), and FIG. 7 shows a state before the cutting means (500) is operated.

FIG. 8 shows the adhesive tape dispenser when the adhesive tape (20) is cut by the cutting means (500).

FIG. 9 shows a state where the double-faced adhesive tape (20) is drawn out by the drawing means (50).

Referring to FIG. 1, the case body (10) generally takes the form of a gun and has the open top and the hollow receptor (10*a*) to receive the adhesive tape (20) therein.

In the receptor (10*a*), the drawing means (50) and the adhesive tape (20) wound in a roll are contained.

The adhesive tape (20) is wound on a bobbin having a perforated central part, through which holding means (13) pass, and rotates in the receptor (10*a*).

The cover (12) is provided above the case body (10) to cover the receptor (10*a*), and it is connected to the case body (10) by the connecting means (300).

As shown in FIG. 1 and FIGS. 4 to 6, the connecting means (300) comprises protrusions (10*b*) provided along an internal periphery of the open top of the case body (10) and also comprises inlet grooves (10*c*) and holding grooves (10*d*) provided at corresponding positions to fit to the protrusions (10*b*) along a lower periphery of the cover (12).

The locking means (600) is provided on a rear part of the cover (12) to either keep the cover (12) and the case body (10) locked or to release the cover (12) from the case body (10).

When the cover (12) is to be connected to the case body (10), the inlet grooves (10*c*) of the cover (12) are placed in line with the protrusions (10*b*) of the case body (10), and then the cover (12) is pushed to move (to the left in the drawings, FIGS. 4 to 6) until the protrusions (10*b*) are fitted to the holding grooves (10*d*).

On the contrary, when the cover (12) is to be released from the case body (10), the cover (12) is pulled to move to the right of the drawings and the protrusions (10*b*) become released from the holding grooves (10*d*) and then through the inlet grooves (10*c*).

The locking means (600) keeps the cover (12) and the case body (10) locked, regardless of repeated slight vibrations and impacts from external environment.

The locking means (600) comprises a button (10*j*) movable in a guide hole (10*g*) formed on the cover (12) and a locking piece (10*i*) integrally formed with the button (10*j*).

A gap (10*h*) in which the locking piece (10*i*) can move is formed between an internal end of the cover (12) and a guider (18). The guider (18) is integrally formed with the cover (12) on its lower interal surface to guide the movement of the adhesive tape (20).

Therefore, when the button (10*j*) is moved with the locking piece (10*i*) (to the right downward of the drawing, FIG. 6), one end of the locking piece (10*i*) is fitted into the gap (10*h*). Thus, movement of the cover (12) back and forth is prohibited.

The locking piece (10*i*) has an elastic protrusion (10*k*) integrally formed therewith and closely attached to the internal surface of the cover (12), to prevent the locking piece (10*i*) from moving by external force or impacts.

In addition, when the connecting means (300) is to be released, the button (10*j*) of the locking means (600) is moved up to release the locking state as shown in FIG. 5 in contrast to FIG. 6. Then, the cover (12) moves slidably on the case body (10) to be released therefrom.

If the cover (12) is separated from the case body (10), the adhesive tape (20) can be replaced with a new one.

Meanwhile, the trigger (15) comes out of the opening (14) formed in the case body (10), so that it is pulled with a finger of a user to drive the drawing means (50).

The drawing means (50) includes a pair of drums (16) rotated by pulling the trigger (15). The drums (16) rotate in contact with a bottom surface of the adhesive tape (20), of which the bottom surface or both surfaces are lined with an adhesive, so that the adhesive tape (20) can be drawn out.

The drawing means (50) is provided in front of the holding means (13), on which the adhesive tape (20) is mounted.

The trigger (15) is provided with a push latch (51) so that the trigger (15) can rotate with an axis of a shaft pin (52). The push latch (51) is elastically supported by a second spring (61), so that one end of the push latch (51) lean on one side of ratchets (17) formed in serial along an internal periphery of the drum (16).

A support (53) is mounted on the shaft pin (52) with the trigger (15). The support (53) is extended throughout the drums (16) until both ends of the support are fitted on the case body (10).

At a upper front end of the support (53), a drawing roller (56) in contact with an adhesive surface of the tape (20) is pivotably provided to idle. Behind the drawing roller (56), a support latch (57) is pivotably provided to be opposite to the push latch (51). The trigger (15) is elastically mounted on the support (53) by a first spring (60), which is fitted on the shaft pin (52).

A guide rod (58) may be provided on a location between the drum (16) and the holding means (13), so that the adhesive surface of the tape (20) can smoothly come into contact with an external surface of the drum (16).

Further, a terraced guide (59) may be provided below the guide rod (58) to guide the adhesive tape (20) which becomes reduced in its diameter as it is unwound.

The second spring (61) is elastically hung on a first jaw (15*a*) formed on a upper side of the trigger (15) and a second jaw (53*a*) formed on a lower side of the support (53).

The first spring (60) is elastically supported on a third jaw (51*a*) formed on the push latch (51) and a fourth jaw (53*b*) formed at a lower surface of the support latch (57).

Therefore, while the trigger (15) is operated, the backlash of the drums (16) can be prevented by the push latch (51). The support latch (57) leans against the ratchets (17) of the drums (16) with idling while the adhesive tape (20) is drawn out, and it prevents the backlash of the drums (16) while it is stopped.

The push latch (51) and the support latch (57) are provided in a pair, keeping a pre-determined width corresponding to the width between the drums (16), such that they can be controlled in association with the ratches (17).

The push latch (51) and the support latch (57) are in contact with the ratchets, each of which has a slope control surface (50*b*).

The drums (16) are rotatably provided at both ends of the shaft pin (52). The drums (16) are provided with the ratchets (17) along internal circumferences thereof and with a belt groove (19*a*) along an external periphery thereof. Further, a pair of auxiliary rollers (19) are axially mounted on both ends of a shaft (70), which is maintained at a predetermined distance from the drums (16) by an interval maintaining means (71). As the shaft (70) and the drums (16) are connected by a belt (72), rotation of the drums (16) causes the auxiliary rollers (19) to rotate.

It is preferable that the auxiliary rollers (19) are formed to have external surfaces in a gear shape to minimize a contact area with the adhesive surface of the tape (20). With the auxiliary rollers (19) configured as such, the adhesive tape (20) can be withdrawn smoothly.

The gear form of the auxiliary rollers (19), rather than a circular form, enables the rollers (19) to have a linear contact with the adhesive tape (20), not a surface contact, so that the adhesive tape (20) can be smoothly drawn out.

Further, the cutting means (500) is provided in the cover (12) to cut off the adhesive tape (20) which has been withdrawn through the drawing means (50).

The cutting means (500) comprises: an operating button (31) mounted on an external surface of the cover (12) and having prominences on a bottom surface thereof;

a movable latch (73) having a protrusion (75) loosely fitted between the prominences of the operating button (31) and having a mouth (74);

a lever (32) including a hanging part (36) to be inserted in the mouth (74), hinge pins (95) on which the lever (62) axially rotates, fitting grooves (32*a*) formed on a bottom surface, and pillars (80) protruded at an end opposite to the hanging part (36);

a cutter (30) having holes (81) to which the pillars (80) are fitted and movable up and down by the lever (32);

a pressing part (34) to press and support the adhesive tape (20) and having a guiding piece (35) integrally extended therefrom in the form of a clip to move up and down the cutter (30) fitted in the clip; and an elastic member (400) including a connecting jaw (32*c*) on which the pressing part (34) hangs, fitting jaws (32*f*) connected with the fitting grooves (32*a*), and a supporting extension (32*e*) in the form of a thin panel to elastically press and support a top surface of the lever (32).

The operation of the cutting means (500) is initiated by pulling the operating button (31), which sequentially moves the movable latch (73) and the lever (32) and then moves the cutter (30) down to cut off the adhesive tape (20).

The lever (32) is supported by the elastic member (400) on its top surface and pivots on the hinge pins (95) provided substantially in the middle of the lever (32). Both ends of the lever (32) moves up and down in association with the movable latch (73).

The movable latch (73) is elastically supported by a third spring (64) and pivotably mounted in the cover (12).

The movable latch (73) includes the protrusion (75) inserted between the prominences on the bottom surface of the operating button (31), and moves by sliding the operating button (31).

As described above and as shown in the drawings, the lever (32) has two pillars (80) protruded at one end to fit into the holes (81) of the cutter (30).

The cutter (30) is inserted in a gap formed between the pressing part (34) and the guiding piece (35). The top end of the pressing part (34) is in contact with the connecting jaw (32*c*) formed at one end of the elastic member (400).

The lever (32) has the fitting grooves (32*a*) formed at both ends of the bottom surface thereof to be connected with the fitting jaws (32*f*) of the elastic member (400). The supporting extension (32*e*) in the form of a thin panel and having a good elasticity presses and supports the lever (32).

The pressing part (34) serves to descend on the adhesive tape (20) before the cutting blade (33) comes in contact with the tape (20) and presses to fix the tape (20), so that the cutter (30) can cut with more stability and accuracy.

When the adhesive tape (20) has been withdrawn with a desired length, the operating button (31) is pulled, and the protrusion (75) rotates the movable latch (73), which in turn moves up the lever (32) around the axis of the hinge pins (95).

The lever (32) has the hanging part (36) inserted in the mouth (74), which is formed in the shape of "⊃" in the movable latch (73).

Therefore, by pulling the operating button (31), the cutting mechanism is initiated, whereby the movable latch (73) moves up the lever (32).

As the lever (32) moves up and down, the elastic member (400) moves. Then, the pressing part (34) which has been hung on the connecting jaw (32*c*) moves down with the cutter (30) and secures on the adhesive tape (20).

Then, if the operating button (31) is pulled further, the rotation of the lever (32) is proceeded further, and the cutter (30) which has been connected with the lever (32) by the pillars (80) descends to cut the adhesive tape (20).

On the contrary, if the operating button (31) returns to its original position, the third spring (64) enforces elasticity to return the movable latch (73) and the lever (32) to their original positions, and the cutter (30) moves up, thus rendering the adhesive tape (20) attached at an end of the tape dispenser of the present invention.

The cutter (30) may comprise a pair of cutting pieces having symmetrical structure as shown in FIG. 3.

Specifically, the cutting pieces have a central axis of symmetry and each of them has a triangular cutting blade (33) to cut the adhesive tape (20) with rapidity and accuracy.

An end corner (93) is formed by smoothly curving a front end part of the cover (12).

Right inside the end corner (93), the cutting means (500) are provided.

Meanwhile, as shown in FIG. 8, a dangle-preventing tongue (11) may be provided at an outlet (90) in order to maintain tension on the adhesive tape (20) while the tape (20) is being drawn out.

Since the dangle-preventing tongue (11) is provided in a withdrawing direction of the adhesive tape (20), the adhesive tape (20) does not hang down, but is always withdrawn straight.

Further, a clearing means (40) may be provided at a front end of the drawing means (50) to get rid of the adhesive of the tape (20) on the surface of the cutter (30).

The clearing means (40) is mounted on a securing jaw (53*c*) formed with the support (53) and comprises an oil tank (41) having a reservoir (42) of a predetermined volume and a cap (43) formed by integrally curving a upper part of the oil tank (41) to partially cover the reservoir (42).

When the cutter (30) descends by the operation of the button (31), the adhesive lined on the bottom surface or both surfaces of the adhesive tape (20) may stick to the cutting blades (33) of the cutting pieces of the cutter (30), which may deteriorate the cutting efficiency afterwards. Thus, the clearing means (40) prevents this kind of undesired situation.

In the present invention with the clearing means (40), the cutter (30) is moved into the oil tank (41) after cutting the adhesive tape (20). At this time, the cutter (30) comes into contact with the oil. Thus, the deterioration of cutting strength of the cutter (30) can be prevented.

It is preferable that the oil contained in the tank (41) is a silicone oil.

Further, it is preferable that the oil tank (41) is made of soft silicone material, so that the tank (41) can be easily curved to form the cap (43). The cap (43) firstly prevents leakage of the oil which may occur during use of the cutter (30). Additionally, a wad of cotton (44) may be provided in the oil tank (41) to prevent the leakage of the oil.

With the structure described above, the tape dispenser of the present invention is held with one hand of a user, and a finger of the user is put on the trigger (15). When the trigger (15) is pulled with the finger once or several times, the adhesive tape (20) wound in the tape dispenser is withdrawn as long as necessary, without having to pull out the adhesive tape (20) directly with the hand.

Then, when the operating button (31) is pulled with a finger, the cutter (30) descends to cut off the adhesive tape (20) which has been withdrawn outside of the tape dispenser. The cutting strength of the cutter (30) does not deteriorate regardless of repeated use for long time.

One of the characteristic features of the present invention is that the guide means (100) is provided above the drums (16) to be in contact with a top surface of the adhesive tape (20) and to guide the adhesive tape (20) to be smoothly drawn out.

As shown in FIG. 6, the guide means (100) comprises a pair of guide rollers (110) provided below the lever (32) with a predetermined interval therebetween and a belt (120) mounted on the guide rollers (110) in consideration of a position in contact with a top surface of the adhesive tape (20).

The guide rollers (110) are axially mounted to rotate freely in the case body (10) and the belt (120) winds on the guide rollers (110) to connect them each other.

Therefore, when the adhesive tape (20) is rotated in contact with the outer periphery of the drawing means (50), the top surface of the adhesive tape (20) is guided to move in contact with a pair of the guide rollers (110) and the belt (120).

The bottom surface of the adhesive tape (20) moves in contact with the belt (72) provided on the drum (16).

As described above, the adhesive tape (20) moves forward with its top surface in contact with the guide means (100) comprising the guide rollers (110) and the belt (120).

As shown in FIG. 9, the guide rollers (110) are symmetrically provided with the belt (120) as the central figure. Preferably, each of the guide rollers (110) has a central convex and flat sides to form a slant (130).

The slant (130) is formed on the guide rollers (110) in order to reduce the contact area with the adhesive tape (20) and to reduce resistance when the adhesive tape (20) is to be detached from the guide rollers (110).

A guide panel (200) may be further provided between the guide rollers (110) to operate the belt (120) smoothly, and it is preferable that the guide panel (200) is provided right above a lower part of the belt (120).

That is, as shown in FIG. 2, the guide panel (200) is provided in a mounting groove (210) and secured on the lower part of the belt (120), and therefore the belt (120) can be guided smoothly.

Further, a discharge roller (140) may be provided in front of the guide rollers (110) to smoothly draw out the adhesive tape (20) which moves forward through the belts (72 and 120).

The discharge roller (140) guides the adhesive tape (20), which is lined with an adhesive on both sides and has been moved forward through the guide means (100) and the drawing means (50), to advance forward more smoothly.

Further, the guide rod (58) is provided behind the guide rollers (110) to guide the movement of the adhesive tape (20) more smoothly with maintaining an appropriate tension on the adhesive tape (20).

The guide rod (58) may be provided at an arbitrary position to rotate freely the adhesive tape (20) in the case body (10).

The invention claimed is:

1. A double-faced adhesive tape dispenser comprising: a case body in the form of a gun having an open top and a receptor to receive an adhesive tape therein;

a cover provided above the case body;

a connecting means to connect a lower end of the cover and a upper end of the case body;

a locking means to prevent the cover from being released from the case body;

a drawing means including a trigger protruded through an opening of the case body, and a pair of drums rotated by pulling the trigger with a finger and in contact with a bottom surface of the adhesive tape to draw out the adhesive tape;

a cutting means including an operating button mounted on an external surface of the cover and having prominences on a bottom surface thereof, a movable latch having a protrusion loosely fitted between the prominences of the operating button and having a mouth, a lever operated by moving the operating button and connected to an elastic member, wherein the lever includes a hanging part to be inserted in the mouth, hinge pins on which the lever axially rotates, fitting grooves formed on a bottom surface, and pillars protruded at an end opposite to the hanging part, and a cutter provided at a front end of the lever and having a blade to cut the adhesive tape—which has been drawn out by the drawing means, the cutter having holes to which the pillars are fitted and movable up and down by the lever, a pressing part to press and support the adhesive tape and having a guiding piece integrally extended therefrom in the form of a clip to move up and down the cutter fitted in the clip, and wherein the elastic member includes a connecting jaw on which the pressing part hangs, fitting jaws connected with the fitting grooves, and a supporting extension in the form of a thin panel to elastically press and support a top surface of the lever; and a guide means provided above the drums to be in contact with a top surface of the adhesive tape and to guide withdrawal of the adhesive tape in the case body.

2. A double-faced adhesive tape dispenser as claimed in claim 1, wherein the connecting means comprises protrusions provided along an internal periphery of the open top of the case body and also comprises inlet grooves and holding grooves provided at corresponding positions to fit to the protrusions along a lower periphery of the cover.

3. A double-faced adhesive tape dispenser as claimed in claim 1, wherein the locking means comprises a button movable in a guide hole formed on the cover and a locking piece integrally formed with the button, and a gap in which the locking piece can move is formed between an internal end of the cover and a guider, which is integrally formed with the cover on its lower internal surface.

4. A double-faced adhesive tape dispenser as claimed in claim 1, wherein the guide means comprises a pair of guide rollers provided below the lever with a predetermined interval therebetween and a belt mounted on the guide rollers in consideration of a position in contact with a top surface of the adhesive tape.

5. A double-faced adhesive tape dispenser as claimed in claim 4, wherein a discharge roller is provided in front of the guide rollers, and a guide panel is further provided above a lower part of the belt.

* * * * *

UNITED STATES PATENT AND TRADEMARK OFFICE

CERTIFICATE OF CORRECTION

PATENT NO. : 7,540,225 B2
APPLICATION NO. : 10/599013
DATED : June 2, 2009
INVENTOR(S) : Sang Chul Lee It is certified that error appears in the above-identified patent and that said Letters Patent is hereby corrected as shown below:

In column 5, line 2, please delete "interal" and replace it with --internal--.

Signed and Sealed this

Twenty-first Day of September, 2010

David J. Kappos

David J. Kappos
*Director of the United States Patent and Trademark Office*